US007270185B2

(12) United States Patent
Fontana et al.

(10) Patent No.: US 7,270,185 B2
(45) Date of Patent: Sep. 18, 2007

(54) DRILLING SYSTEM AND METHOD FOR CONTROLLING EQUIVALENT CIRCULATING DENSITY DURING DRILLING OF WELLBORES

(75) Inventors: Peter Fontana, Amsterdam (NL); Larry Watkins, Houston, TX (US); Peter Aronstam, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/191,152

(22) Filed: Jul. 9, 2002

(65) Prior Publication Data

US 2003/0066650 A1 Apr. 10, 2003
US 2006/0065402 A9 Mar. 30, 2006

Related U.S. Application Data

(63) Continuation-in-part of application No. 10/094,208, filed on Mar. 8, 2002, now Pat. No. 6,648,081, which is a continuation of application No. 09/353,275, filed on Jul. 14, 1999, now Pat. No. 6,415,877.

(60) Provisional application No. 60/323,797, filed on Sep. 20, 2001, provisional application No. 60/304,160, filed on Jul. 10, 2001, provisional application No. 60/303,959, filed on Jul. 9, 2001, provisional application No. 60/108,601, filed on Nov. 16, 1998, provisional application No. 60/101,541, filed on Sep. 23, 1998, provisional application No. 60/095,188, filed on Aug. 3, 1998, provisional application No. 60/092,908, filed on Jul. 15, 1998.

(51) Int. Cl.
*E21B 29/12* (2006.01)

(52) U.S. Cl. ..... 166/358; 166/367; 166/347; 175/5

(58) Field of Classification Search ..... 166/344, 166/347, 358, 359, 360, 367, 368; 175/5, 175/8
See application file for complete search history.

(56) References Cited

U.S. PATENT DOCUMENTS 2,812,723 A 11/1957 Coberly (Continued)

*Primary Examiner*—Thomas A Beach
(74) *Attorney, Agent, or Firm*—Madan, Mossman & Sriram, P.C.

(57) ABSTRACT

A drilling system for drilling subsea wellbores includes a tubing-conveyed drill bit that passes through a subsea wellhead. Surface supplied drilling fluid flows through the tubing, discharges at the drill bit, returns to the wellhead through a wellbore annulus, and flows to the surface via a riser extending from the wellhead. A flow restriction device positioned in the riser restricts the flow of the returning fluid while an active fluid device controllably discharges fluid from a location below to just above the flow restriction device in the riser, thereby controlling bottomhole pressure and equivalent circulating density ("ECD"). Alternatively, the fluid is discharged into a separate return line thereby providing dual gradient drilling while controlling bottomhole pressure and ECD. A controller controls the energy and thus the speed of the pump in response to downhole measurement(s) to maintain the ECD at a predetermined value or within a predetermined range.

26 Claims, 5 Drawing Sheets

U.S. PATENT DOCUMENTS

| | | | | | |
|---|---|---|---|---|---|
| 2,946,565 | A | | 7/1960 | Williams | |
| 3,595,075 | A | | 7/1971 | Dower | |
| 3,603,409 | A | | 9/1971 | Watkins | |
| 3,677,353 | A | | 7/1972 | Baker | |
| 3,815,673 | A | | 6/1974 | Bruce et al. | |
| 3,958,651 | A | | 5/1976 | Young | |
| 4,022,285 | A | | 5/1977 | Frank | |
| 4,046,191 | A | * | 9/1977 | Neath | 166/352 |
| 4,049,066 | A | | 9/1977 | Richey | |
| 4,063,602 | A | * | 12/1977 | Howell et al. | 175/7 |
| 4,091,881 | A | * | 5/1978 | Maus | 175/7 |
| 4,099,583 | A | | 7/1978 | Maus | |
| 4,108,257 | A | | 8/1978 | Sizer | |
| 4,134,461 | A | | 1/1979 | Blomsma | |
| 4,137,975 | A | | 2/1979 | Pennock | |
| 4,149,603 | A | | 4/1979 | Arnold | |
| 4,210,208 | A | | 7/1980 | Shanks | |
| 4,223,747 | A | | 9/1980 | Marais | |
| 4,240,513 | A | | 12/1980 | Castel et al. | |
| 4,291,772 | A | * | 9/1981 | Beynet | 175/5 |
| 4,368,787 | A | | 1/1983 | Messenger | |
| 4,436,166 | A | | 3/1984 | Hayatdavoudi et al. | |
| 4,440,239 | A | | 4/1984 | Evans | |
| 4,534,426 | A | | 8/1985 | Hooper | |
| 4,577,700 | A | * | 3/1986 | Dellinger et al. | 175/40 |
| 4,613,003 | A | | 9/1986 | Ruhle | |
| 4,630,691 | A | | 12/1986 | Hooper | |
| 4,744,426 | A | | 5/1988 | Reed | |
| 4,813,495 | A | * | 3/1989 | Leach | 175/6 |
| 5,150,757 | A | | 9/1992 | Nunley | |
| 5,168,932 | A | | 12/1992 | Worrall et al. | |
| 5,355,967 | A | | 10/1994 | Mueller et al. | |
| 5,651,420 | A | | 7/1997 | Tibbitts et al. | |
| 5,775,443 | A | | 7/1998 | Lott | |
| 5,848,656 | A | * | 12/1998 | M.o slashed.ksvold | 175/7 |
| 6,062,313 | A | * | 5/2000 | Moore | 166/357 |
| 6,068,053 | A | * | 5/2000 | Shaw | 166/267 |
| 6,102,673 | A | * | 8/2000 | Mott et al. | 417/392 |
| 6,142,236 | A | | 11/2000 | Brammer et al. | |
| 6,216,799 | B1 | | 4/2001 | Gonzalez | |
| 6,276,455 | B1 | | 8/2001 | Gonzalez | |
| 6,328,107 | B1 | * | 12/2001 | Maus | 166/335 |
| 6,374,925 | B1 | | 4/2002 | Elkins et al. | 175/25 |
| 6,415,877 | B1 | * | 7/2002 | Fincher et al. | 175/5 |
| 6,457,529 | B2 | * | 10/2002 | Calder et al. | 166/368 |
| 6,527,513 | B1 | | 3/2003 | Van Drentham-Susman et al. | 415/202 |
| 6,530,437 | B2 | * | 3/2003 | Maurer et al. | 175/5 |
| 6,648,081 | B2 | * | 11/2003 | Fincher et al. | 175/25 |
| 6,651,745 | B1 | * | 11/2003 | Lush et al. | 166/357 |
| 6,719,071 | B1 | | 4/2004 | Moyes | 175/65 |
| 2003/0146001 | A1 | | 8/2003 | Hosie et al. | |

FOREIGN PATENT DOCUMENTS

| | | |
|---|---|---|
| CA | WO 02/14649 | 2/2002 |
| EP | 0290250 | 9/1988 |
| WO | WO 00/50731 | 8/2000 |
| WO | WO 03/023182 A1 | 3/2003 |

OTHER PUBLICATIONS

*Continuous Circulation Drilling*, L. J. Ayling, Maris Int'l Ltd.; J. W. Jenner, Maris Int'l Ltd., H. Elkins, Varco Drilling Dquipment, this paper prepared for presentation at the 2002 Offshore Technology Confrence, Houston, Texas May 6-9, 2002.

* cited by examiner

DRILLING SYSTEM AND METHOD FOR CONTROLLING EQUIVALENT CIRCULATING DENSITY DURING DRILLING OF WELLBORES

CROSS-REFERENCES TO RELATED APPLICATIONS

This application takes priority from Provisional U.S. Patent Applications Ser. Nos. 60/303,959 and 60/304,160, filed on Jul. 9, 2001 and Jul. 10, 2001 respectively, and Provisional U.S. Patent Application Ser. No. 60/323,797, filed on Sep. 20, 2001. This application is a continuation-in-part of U.S. patent application Ser. No. 10/094,208, filed Mar. 8, 2002, now U.S. Pat. No. 6,848,081 granted on Nov. 18, 2003, which is a continuation of U.S. application Ser. No. 09/353,275, filed Jul. 14, 1999, now U.S. Pat. No. 6,415,877, which claims benefit of U.S. Provisional Application No. 60/108,601, filed Nov. 16, 1998, U.S. Provisional Application No. 60/101,541, filed Sep. 23, 1998, U.S. Provisional Application No. 60/092,908, filed, Jul. 15, 1998 and U.S. Provisional Application No. 60/095,188, filed Aug. 3, 1998.

BACKGROUND OF THE INVENTION

1. Field of the Invention

This invention relates generally to oilfield wellbore drilling systems and more particularly to subsea drilling systems that control bottom hole pressure or equivalent circulating density during drilling of the wellbores.

2. Background of the Art

Oilfield wellbores are drilled by rotating a drill bit conveyed into the wellbore by a drill string. The drill string includes a drilling assembly (also referred to as the "bottom hole assembly" or "BHA") that carries the drill bit. The BHA is conveyed into the wellbore by a tubing. Coiled tubing or jointed tubing is utilized to convey the drilling assembly into the wellbore. The drilling assembly sometimes includes a drilling motor or a "mud motor" that rotates the drill bit. The drilling assembly also includes a variety of sensors for taking measurements of a variety of drilling, formation and BHA parameters. A suitable drilling fluid (commonly referred to as the "mud") is supplied or pumped from the surface down the tubing. The drilling fluid drives the mud motor and then it discharges at the bottom of the drill bit. The drilling fluid returns uphole via the annulus between the drill string and the wellbore and carries with it pieces of formation (commonly referred to as the "cuttings") cut or produced by the drill bit in drilling the wellbore.

For drilling wellbores under water (referred to in the industry as "offshore" or "subsea" drilling) tubing is provided at the surface work station (located on a vessel or platform). One or more tubing injectors or rigs are used to move the tubing into and out of the wellbore. In sub-sea riser-type drilling, a riser, which is formed by joining sections of casing or pipe, is deployed between the drilling vessel and the wellhead equipment at the sea bottom and is utilized to guide the tubing to the wellhead. The riser also serves as a conduit for fluid returning from the wellhead to the vessel at sea surface.

During drilling, the drilling operator attempts to carefully control the fluid density at the surface so as to prevent an overburdened condition in the wellbore. In other words, the operator maintains the hydrostatic pressure of the drilling fluid in the wellbore above the formation or pore pressure to avoid well blow-out. The density of the drilling fluid and the fluid flow rate largely determine the effectiveness of the drilling fluid to carry the cuttings to the surface. One important downhole parameter during drilling is the bottom-hole pressure, which is effectively the equivalent circulating density ("ECD") of the fluid at the wellbore bottom.

This term, ECD, describes the condition that exists when the drilling mud in the well is circulated. ECD is the friction pressure caused by the fluid circulating through the annulus of the open hole and the casing(s) on its way back to the surface. This causes an increase in the pressure profile along this path that is different from the pressure profile when the well is in a static condition (i.e., not circulating). In addition to the increase in pressure while circulating, there is an additional increase in pressure while drilling due to the introduction of drill solids into the fluid. This pressure increase along the annulus of the well can negatively impact drilling operations by fracturing the formation at the shoe of the last casing. This can reduce the amount of hole that can be drilled before having to set an additional casing. In addition, the rate of circulation that can be achieved is also limited. Due to this circulating pressure increase, the ability to clean the hole is severely restricted. This condition is exacerbated when drilling an offshore well. In offshore wells, the difference between the fracture pressures in the shallow sections of the well and the pore pressures of the deeper sections is considerably smaller compared to on-shore wellbores. This is due to the seawater gradient versus the gradient that would exist if there were soil overburden for the same depth.

In order to be able to drill a well of this type to a total wellbore depth at a subsea location, the bottom hole ECD must be reduced or controlled. One approach to do so is to use a mud filled riser to form a subsea fluid circulation system utilizing the tubing, BHA, the annulus between the tubing and the wellbore and the mud filled riser, and then inject gas (or some other low density liquid) in the primary drilling fluid (typically in the annulus adjacent the BHA) to reduce the density of fluid downstream (i.e., in the remainder of the fluid circulation system). This so-called "dual density" approach is often referred to as drilling with compressible fluids.

Another method for changing the density gradient in a deepwater return fluid path has been proposed. This approach proposes to use a tank, such as an elastic bag, at the sea floor for receiving return fluid from the wellbore annulus and holding it at the hydrostatic pressure of the water at the sea floor. Independent of the flow in the annulus, a separate return line connected to the sea floor storage tank and a subsea lifting pump delivers the return fluid to the surface. Although this technique (which is referred to as "dual gradient" drilling) would use a single fluid, it would also require a discontinuity in the hydraulic gradient line between the sea floor storage tank and the subsea lifting pump. This requires close monitoring and control of the pressure at the subsea storage tank, subsea hydrostatic water pressure, subsea lifting pump operation and the surface pump delivering drilling fluids under pressure into the tubing for flow downhole. The level of complexity of the required subsea instrumentation and controls as well as the difficulty of deployment of the system has delayed the commercial application of the "dual gradient" system.

Another approach is described in U.S. patent application Ser. No. 09/353,275, filed on Jul. 14, 1999 and assigned to the assignee of the present application. The U.S. patent application Ser. No. 09/353,275 is incorporated herein by reference in its entirety. One embodiment of this application describes a riserless system wherein a centrifugal pump in a separate return line controls the fluid flow to the surface and thus the equivalent circulating density.

The present invention provides a wellbore system wherein equivalent circulating density is controlled by controllably bypassing the returning fluid about a restriction in the returning fluid path of a riser utilizing an active differential pressure device, such as a centrifugal pump or turbine, located adjacent to the riser. The fluid is then returned into the riser above the restriction. The present invention also provides a dual gradient subsea drilling system wherein equivalent circulating density is controlled by controllably bypassing the returning fluid about a restriction in a riser by utilizing an active differential pressure device, such as a centrifugal pump or turbine located some distance above the sea bed. The present systems are relatively easy to incorporate in new and existing systems.

SUMMARY OF THE INVENTION

The present invention provides wellbore systems for performing subsea downhole wellbore operations, such as subsea drilling as described more fully hereinafter. Such drilling systems include a rig at the sea level that moves a drill string into and out of the wellbore. A bottom hole assembly, carrying the drill bit, is attached to the bottom end of the tubing. A wellhead assembly or equipment at the sea bottom receives the bottom hole assembly and the tubing. A drilling fluid system supplies a drilling fluid into a fluid circuit that supports wellbore operations. In one embodiment, the fluid circuit includes a supply conduit and a return conduit. The supply conduit includes a tubing string that receives drilling fluid from the fluid system. This fluid is discharged at the drill bit and returns to the wellhead equipment carrying the drill cuttings. The return conduit includes a riser dispersed between the wellhead equipment and the surface that guides the drill string and provides a conduit for moving the returning fluid to the surface.

In one embodiment of the present invention, a flow restriction device in the riser restricts the flow of the returning fluid through the riser. Preferably, the flow restriction device moves between a substantially open bore and closed bore positions and accommodates the axial sliding and rotation movement of the drill string. In one embodiment, radial bearings stabilize the drill string while a hydraulically actuated packer assembly provides selective obstruction of the riser bore and therefore selectively diverts return fluid flow into a flow diverter line provided below the flow restriction device. Additionally, a seal such as a rotary seal is used to further restrict flow of return fluid through the flow restriction device. A fluid flow device, such as a centrifugal pump or turbine in the flow diverter line causes a pressure differential in the returning fluid as it flows from just below the flow restriction device to above the flow restriction device. The pump speed is controlled, by controlling the energy input to the pump. One or more pressure sensors provide pressure measurement of the circulating fluid. A controller controls the operation of the pump to control the amount of the differential pressure across the pump and thus the equivalent circulating density. The controller maintains the equivalent circulating density at a predetermined level or within a predetermined range in response to programmed instructions provided to the controller. The pump is mounted on the outside of the riser joint, typically at a sufficient depth below the sea level to provide enough lift to offset the desired amount of ECD. Alternatively, the flow restriction device and the pump may be disposed in the return fluid path in the annulus between the wellbore and the drill string. The present system is equally useful as an at-balance or an underbalanced drilling system.

In another embodiment of the present invention, a flow restriction device in the riser restricts the flow of the returning fluid through the riser. A flow diverter line, active pressure differential device ("APD Device") and a separate return line provide a fluid flow path around the flow restriction device. In this embodiment, dual gradient drilling with active control of wellbore pressure is achieved mid riser or at a selected point in the riser, the selected point between the surface and sea bottom. The active pressure differential device, such as centrifugal pumps or turbines, moves the returning fluid from just below the flow restriction device to the surface via the separate return line. The operation of the active pressure differential device is controlled to create a differential pressure across the device, thereby reducing the bottomhole pressure. The pumps or turbines speeds are controlled, by controlling the energy input to the pumps or turbines. One or more pressure sensors provide pressure measurements of the circulating fluid. A controller controls the operation of the pumps or turbines to control the amount of the pressure differential and thus the equivalent circulating density. The controller maintains the bottom hole pressure and the equivalent circulating density at a predetermined level or within a predetermined range in response to programmed instructions provided to the controller. The pumps or turbines are mounted on the outside of the riser, typically between 1000 to 3000 ft. below sea level, but above the sea bed. The present system is equally useful in maintaining the bottomhole pressure at an at-balance or under-balance condition.

Examples of the more important features of the invention have been summarized (albeit rather broadly) in order that the detailed description thereof that follows may be better understood and in order that the contributions they represent to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawing.

DETAILED DESCRIPTION OF PREFERRED EMBODIMENTS

Figure 1:
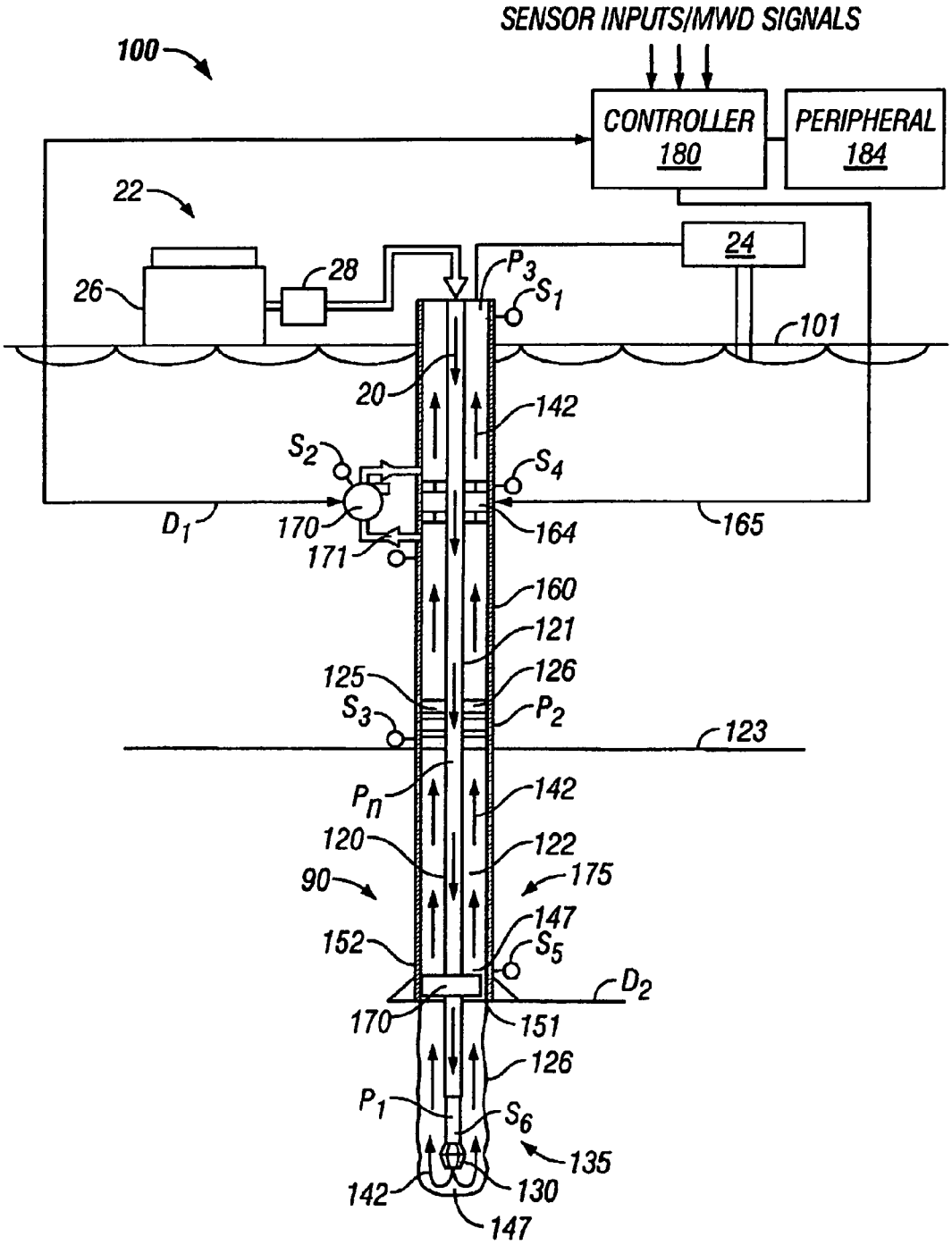
FIG. 1 is a schematic elevation view of one embodiment of a wellbore system for controlling equivalent circulating density during drilling of subsea wellbores.

FIG. 1 shows a schematic elevational view of a wellbore drilling system 100 for drilling a subsea or under water wellbore 90. The drilling system 100 includes a drilling platform 101, which may be a drill ship or another suitable surface work station such as a floating platform or a semi-submersible. A drilling ship or a floating rig is usually preferred for drilling deep water wellbores, such as wellbores drilled under several thousand feet of water. To drill a wellbore 90 under water, wellhead equipment 125 is deployed above the wellbore 90 at the sea bed or bottom 123. The wellhead equipment 125 includes a blow-outpreventer stack 126. A lubricator (not shown) with its associated flow control valves may be provided over the blow-outpreventer 126.

The subsea wellbore 90 is drilled by a drill bit 130 carried by a drill string 120, which includes a drilling assembly or a bottom hole assembly ("BHA") 135 at the bottom of a suitable tubing 121, which may be a coiled tubing or a jointed pipe. The tubing 121 is placed at the drilling platform 101. To drill the wellbore 90, the BHA 135 is conveyed from the vessel 101 to the wellhead equipment 125 and then inserted into the wellbore 90. The tubing 121 is moved to the wellhead equipment 125 and then moved into and out of the wellbore 90 by a suitable tubing injection system.

To drill the wellbore 90, a drilling fluid 20 from a surface drilling fluid system or mud system 22 is directed into a fluid circuit that services the wellbore 90. This fluid can be pressurized or use primarily gravity assisted flow. In one embodiment, the mud system 22 includes a mud pit or supply source 26 and one or more pumps 28 in fluid communication with a supply conduit of the fluid circuit. The fluid is pumped down the supply conduit, which includes the tubing 121. The drilling fluid 20 may operate a mud motor in the BHA 135, which in turn rotates the drill bit 130. The drill bit 130 breaks or cuts the formation (rock) into cuttings 147. The drilling fluid 142 leaving the drill bit travels uphole through a return conduit of the fluid circuit. In one embodiment, the return conduit includes the annulus 122 between the drill string 120 and the wellbore wall 126 carrying the drill cuttings 147. The return circuit also includes a riser 160 between the wellhead 125 and the surface 101 that carries the returning fluid 142 from the wellbore 90 to the sea level. The returning fluid 142 discharges into a separator 24, which separates the cuttings 147 and other solids from the returning fluid 142 and discharges the clean fluid into the mud pit 26. The tubing 121 passes through the mud-filled riser 160. As shown in FIG. 1, the clean mud 20 is pumped through the tubing 121 and the mud 142 with cuttings 147 returns to the surface via the annulus 122 up to the wellhead 125 and then via the riser 160. Thus, the fluid circulation system or fluid circuit includes a supply conduit (e.g., the tubing 121) and a return conduit (e.g., the annulus 122 and the riser 160). Thus, in one embodiment the riser constitutes an active part of the fluid circulation system.

As noted above, the present invention provides a drilling system for controlling wellbore pressure and controlling or reducing the ECD effect during drilling fluid circulation or drilling of subsea wellbores. To achieve the desired control of the ECD, the present invention selectively adjusts the pressure gradient of the fluid circulation system. One embodiment of the present invention utilizes an arrangement wherein the flow of return fluid is controlled (e.g., assisted) at a predetermined elevation along the riser 160. An exemplary arrangement of such an embodiment includes a flow restriction device 164 in the drilling riser 160 and an actively controlled fluid lifting device 170.

Figure 2:
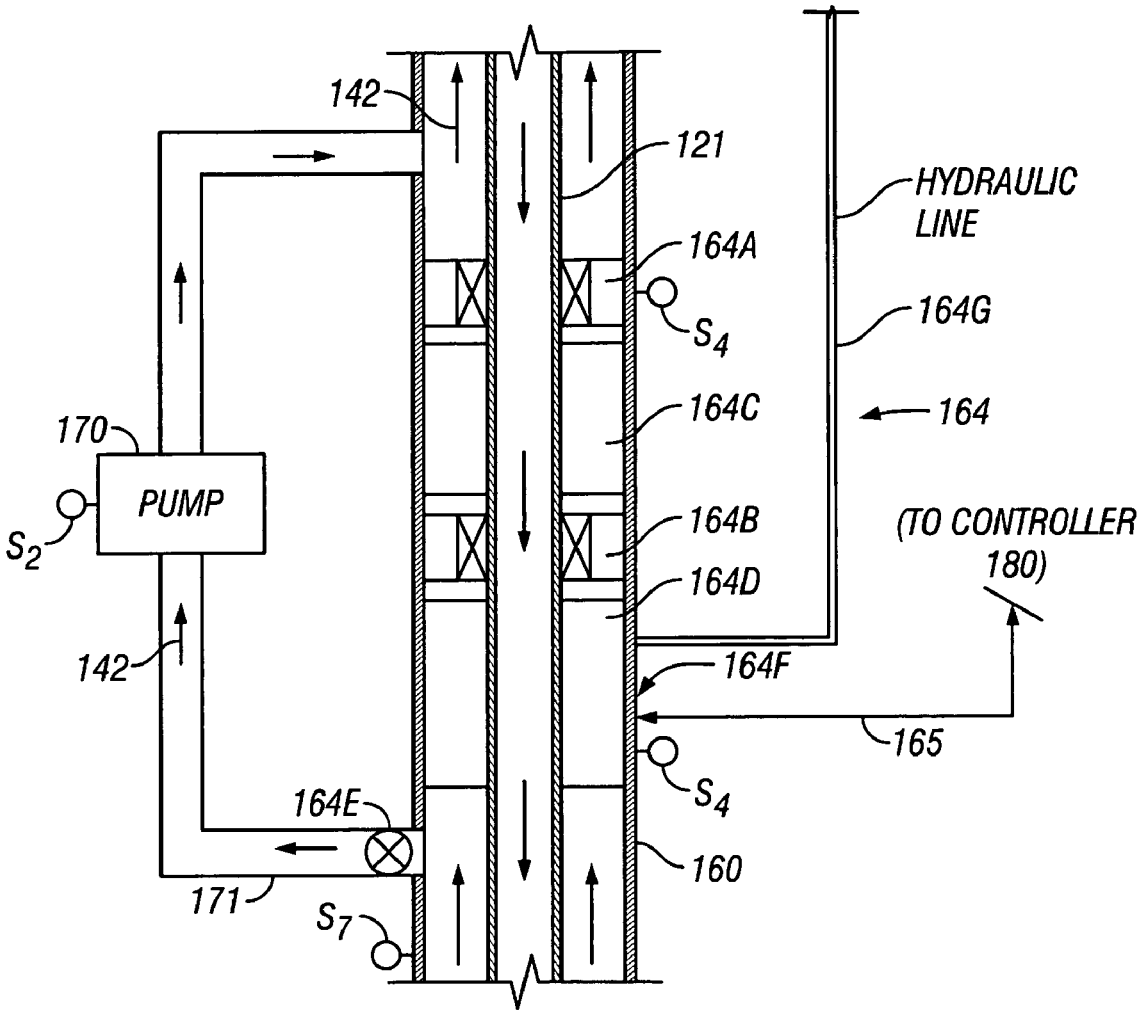
FIG. 2 is a schematic elevation view of a flow restriction device and active differential pressure device made in accordance with one embodiment of the present invention.

Referring now to FIG. 2, an exemplary flow restriction device 164 diverts return fluid flow from the riser 160 to the fluid lifting device 170. Preferably, the flow restriction device 164 can move between a substantially open bore position (no flow restriction) and a substantially closed bore position (substantial flow restriction). It is also preferred that the flow restriction device 164 accommodate both the axial sliding and rotation movement of the drill string 121 when in the substantially closed position. Accordingly, in a preferred embodiment of the flow restriction device 164, upper and lower radial bearings 164A, 164B are used to stabilize the drill string 121 during movement. Further, a hydraulically actuated packer assembly 164D provides selective obstruction of the bore of the riser 160. When energized with hydraulic fluid via a hydraulic line 164G, the inflatable elements of the packer assembly 164D expand to grip the drill string 121 and thereby substantially divert return fluid flow 142 into the diverter line 171. Intermediate elements such as concentric tubular sleeve bearings (not shown) can be interposed between the packer assembly 164D and the drill string 121. Additionally, a seal 164C such as a rotary seal can be provide an additional barrier against the flow of return fluid 142 through the flow restriction device 164. When de-energized, the packer assembly 164D disengages from the drill string 121 and retracts toward the wall of the riser 160. This retraction reduces the obstruction of the bore of the riser 160 and thereby enables large diameter equipment (not shown) to cross the flow restriction device 164 while, for example, the drill string 121 is tripped in and out of the riser 160. Preferably, the flow restriction device 164 is positioned in a housing joint 164F, which can be a slip joint housing. Elements such as the bearings 164A,B and seal 164C can be configured to reside permanently in the housing joint 164F or mount on the drill string 121. In one preferred arrangement, element that are subjected to relatively high wear are positioned on the drill string 121 and changed out when the drill string 121 is tripped. Furthermore, a certain controlled clearance is preferably provided between the drill string 121 and the flow restriction device 164 so that upset portion of the drill string 121 (e.g., jointed connections) can slide or pass through the flow restriction device 164.

The flow restriction device 164 may be adjustable from a surface location via a control line 165, which allows the control over the pressure differential through the riser. The depth at which the flow restriction device 164 is installed will depend upon the maximum desired reduction in the ECD. A depth of between 1000 ft to 3000 ft. is considered adequate for most subsea applications. The returning fluid 142 in the riser 160 is diverted about the restriction device 164 by a fluid lifting device, such as centrifugal pump 170 coupled to a flow cross line or a diverter line 171. The diverter line 171 is installed from a location below the flow restriction device 164 to a location above the flow restriction device 164. Thus, the lifting device 170 diverts the returning fluid in the riser from below the flow restriction device to above the flow restriction device 164. The fluid lifting device 170 is mounted on the exterior of the riser 160. To control the ECD at a desired value, the pump speed (RPM) is controlled. Typically, the energy input to (and thus the RPM of) the pump 170 is increased as the fluid flow in the circulating path is increased and/or the length of the circulating path increases with advancement of the drill bit. Moreover, the energy input to (and thus the RPM of) the lifting device is decreased as the return flow in the well 90 (FIG. 1) is decreased. In this configuration, the lifting device takes on part of the work of pushing or lifting the drilling fluid back to the surface from the restriction device location. The energy input into the lifting device 170 (i.e. the work performed by the device) results in reducing the hydrostatic pressure of the fluid column below that point, which results in a corresponding reduction of the pressure along the return path in the annulus below the lifting device 170 and more specifically at the shoe 151 of the last casing 152. Any number of devices such as centrifugal pumps, turbines, jet pumps, positive displacement pumps and the like can be suitable for providing a pressure differential and associated control of ECD. The terms active pressure differential device ("APD" device), active fluid flow device and active fluid lifting device are intended to encompass at least such devices, mechanisms and arrangements.

Referring now to FIG. 1, in an alternative embodiment, the flow restriction device 164 and the pump 170 may be installed at a suitable location in the wellbore annulus, such as shown by arrow 175, or at the wellhead equipment 125. Also, the present invention is equally applicable to underbalanced drilling systems since it is capable of controlling the ECD effect to a desired level.

Referring now to FIGS. 1 and 2, the wellbore system 100 further includes a controller 180 at the surface that is adapted to receive input or signals from a variety of sensors including those in remote equipment such as the BHA 135. The system 100 includes one or more pressure sensors, such as $P_1$ and a host of other sensors $S_{1-7}$ that provide measurements relating to a variety of drilling parameters, such as fluid flow rate, temperature, weight-on bit, rate of penetration, etc., drilling assembly or BHA parameters, such as vibration, stick slip, RPM, inclination, direction, BHA location, etc. and formation or formation evaluation parameters commonly referred to as measurement-while-drilling parameters such as resistivity, acoustic, nuclear, NMR, etc. Drilling fluid pressure measurements may also be obtained at wellhead ($P_2$) and at the surface ($P_3$) or at any other suitable location ($P_n$) along the drill string 120. Further, the status and condition of equipment as well as parameters relating to ambient conditions (as well as pressure and other parameters listed above) in the system 100 can be monitored by sensors positioned throughout the system 100: exemplary locations including at the surface (S1), at the fluid lifting device (S2), at the wellhead equipment 125 (S3), at the fluid restriction device 164 (S4), near the casing shoe 151B (S5), at bottomhole assembly (S6), and near the inlet to the active fluid lifting device 170 (S7). The data provided by these sensors are transmitted to the controller 180 by a suitable telemetry system (not shown).

During drilling, the controller 180 receives the pressure information from one or more of the sensors ($P_1$-$P_n$) and/or information from other sensors ($S_1$-$S_7$) in the system 100. The controller 180 determines the ECD and adjusts the energy input to the lifting device 170 to maintain the ECD at a desired or predetermined value or within a desired or predetermined range. The controller 180 includes a microprocessor or a computer, peripherals 184 and programs which are capable of making online decisions regarding the control of the flow restriction device 164 and the energy input to the lifting device 170. A speed sensor $S_2$ may be used to determine the pump speed. Thus, the location of the flow restriction device 164 and the pressure differential about the restriction device controls the ECD. The wellbore system 100 thus provides a closed loop system for controlling the ECD by controllably diverting the returning fluid about a flow restriction device in the returning fluid path in response to one or more parameters of interest during drilling of a wellbore. This system is relatively simple and efficient and can be incorporated into new or existing drilling systems.

Figure 3B:
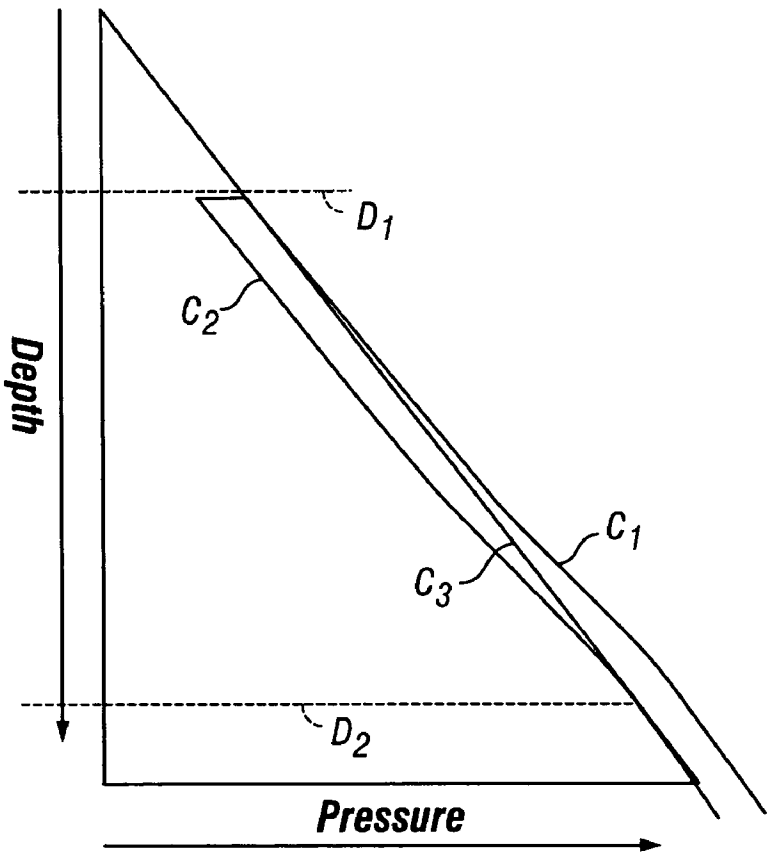
FIGS. 3A and 3B illustrate pressure gradient curves provided by the FIG. 1 embodiment of the present invention.
Figure 3A:
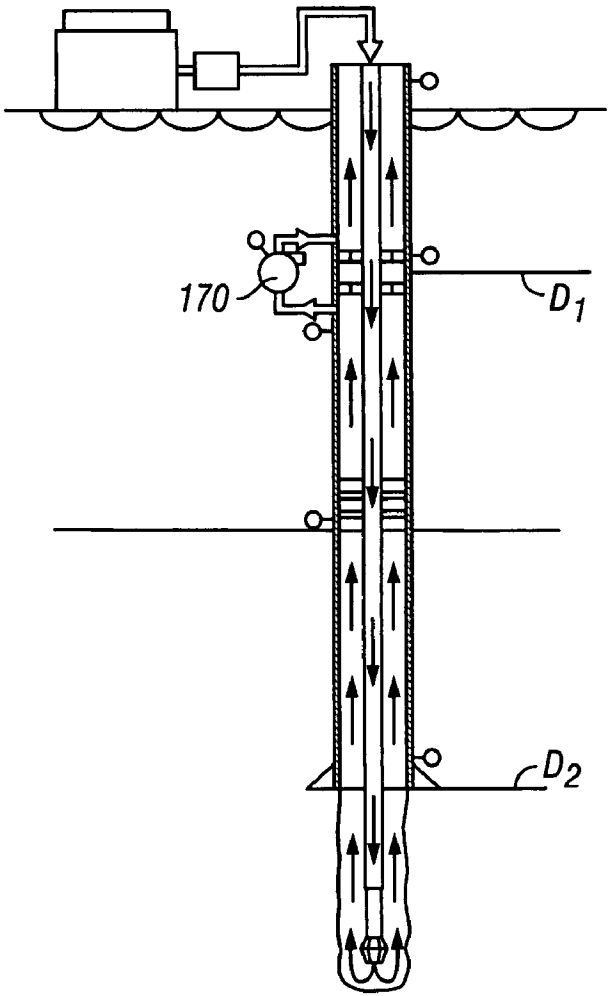

Referring now to FIGS. 3A and 3B, there is graphically illustrated the ECD control provided by the above-described embodiment of the present invention. For convenience, FIG. 3A shows the fluid lifting device 164 at a depth D1 and a representative location in the wellbore such as the casing shoe 151 at a lower depth D2. FIG. 3B provides a depth versus pressure graph having a first curve C1 representative of a pressure gradient before operation of the system 100 and a second curve C2 representative of a pressure gradients during operation of the system 100. Curve C3 represents a theoretical curve wherein the ECD condition is not present; i.e., when the well is static and not circulating and is free of drill cuttings. It will be seen that a target or selected pressure at depth D2 under curve C3 cannot be met with curve C1. Advantageously, the system 100 reduces the hydrostatic pressure at depth D1. and thus shifts the pressure gradient as shown by curve C3, which can provide the desired predetermined pressure at depth D2. This shift is roughly the pressure drop provided by the fluid lifting device 170.

Figure 4:
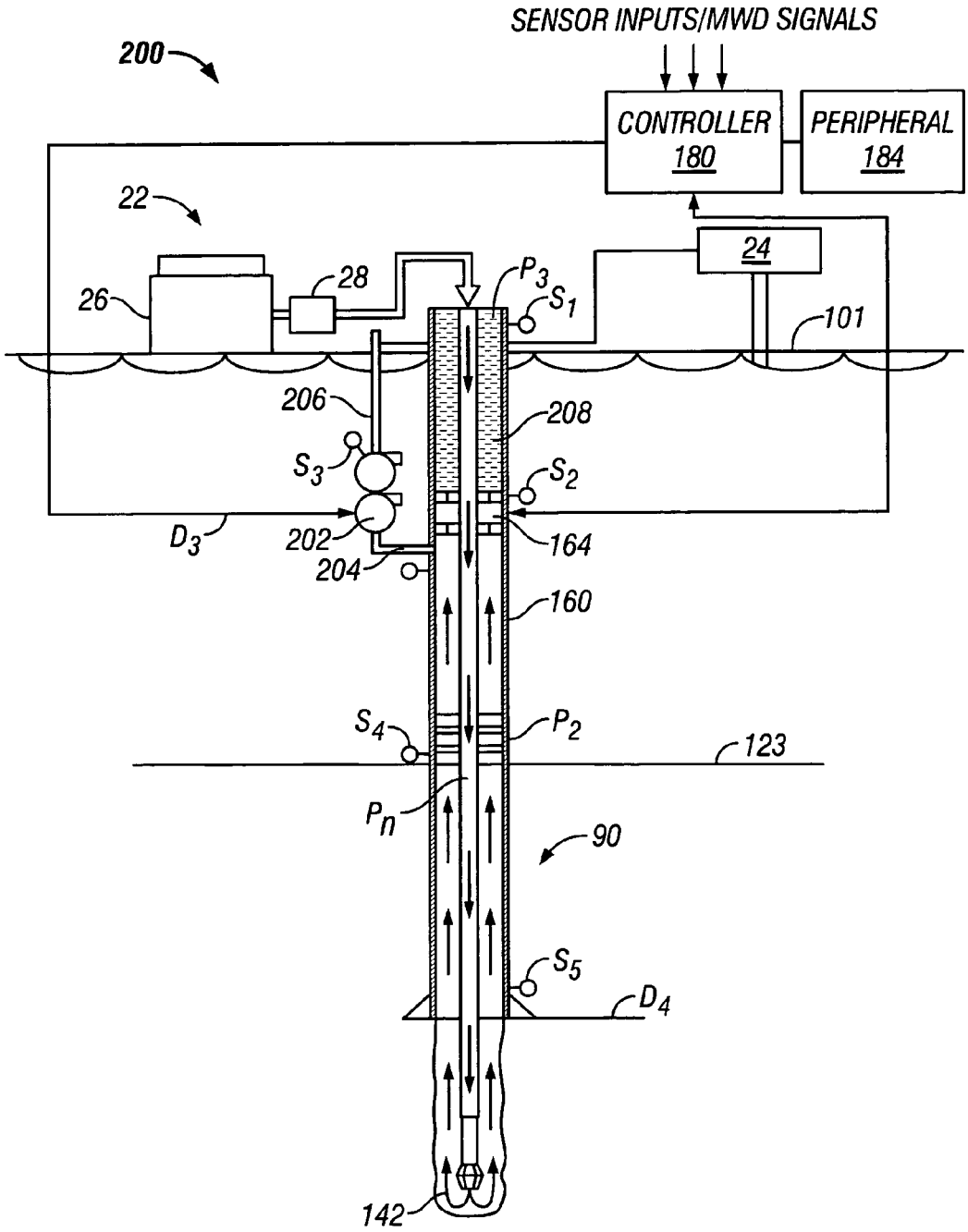
FIG. 4 is a schematic elevation view of one embodiment of a wellbore system for controlling equivalent circulating density and bottomhole pressure during dual gradient drilling of subsea wellbores with the device mounted at a point in the riser between the surface and the seabed.

Referring now to FIG. 4, there is shown another embodiment of the present invention that is suitable for dual gradient drilling. Features the same as those in FIG. 1 are, for convenience, referenced with the same numerals. The FIG. 4 embodiment includes a system 200 wherein the returning fluid 142 in the riser 160 is diverted about the restriction device 164 by an active pressure differential device 202 coupled to a flow cross line or a diverter line 204. The diverter line 204 is installed at a location below the flow restriction device 164. Thus, the active pressure differential device 202 diverts the returning fluid 142 in the riser 160 from below the flow restriction device 164 to the surface. The active pressure differential device 202 is mounted above the seabed and external to riser 160. The operation of the active pressure differential device 202 creates a selected pressure differential across the device 202. It also moves the returning fluid 142 from just below the flow restriction device 164 and discharges the diverted fluid into a separate return line 206, which carries the fluid to the surface by bypassing the portion of the riser 160 that is above the flow restriction device 164. FIG. 4 further illustrates a material 208, having a lower density than the return fluid and obtained from a suitable source at or near the surface, is maintained in the riser 160 uphole of restriction device 164. The material 208 usually is seawater. However, a suitable fluid could have a density less or greater than seawater. The material 208 is used in providing a static pressure gradient to the wellbore that is less than the pressure gradient formed by the fluid downhole of the flow restriction device 164. Drilling is performed in a similar manner to that described with respect to the FIG. 1 embodiment except that the active pressure differential device 202 discharges the return fluid 142 into the separate return line 206 that may be external to the riser 160. Thereafter, the return fluid 142 is discharged into the separator 24.

To achieve the desired reduction and/or control of the bottomhole pressure or ECD, the system 200 utilizes a flow restriction device 164 and active pressure differential device 202 in much the same manner as that described in reference to system 100 (FIG. 1). That is, briefly, the active pressure differential device 202 provides lift to the return fluid, above its location reducing the hydrostatic pressure of the fluid column below that point. This results in a corresponding reduction of the pressure along the return path and more specifically at the shoe 151 of the last casing 152. Therefore, control of the active pressure differential device allows for control of the wellbore pressure and ECD.

Figure 5B:
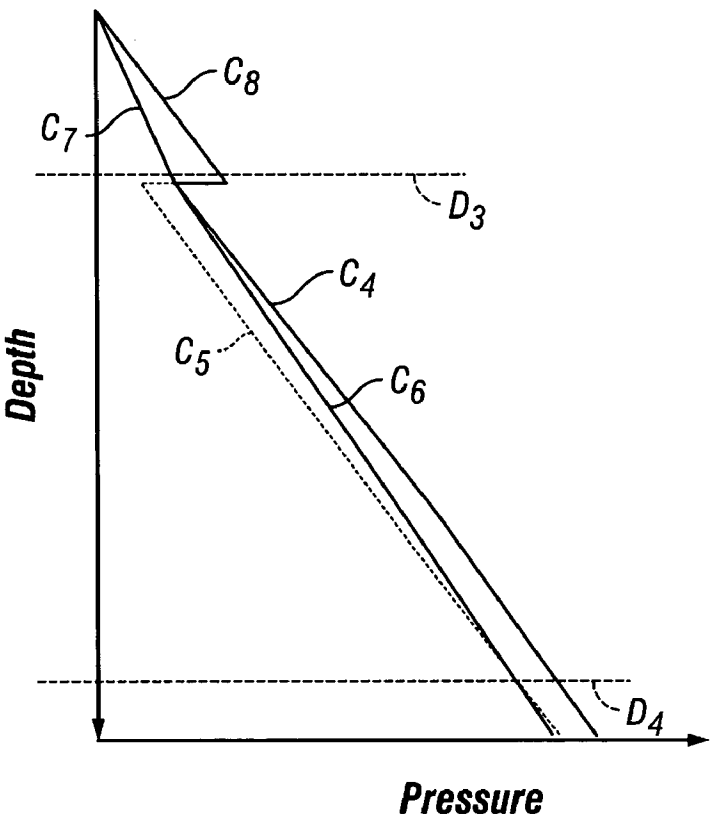
FIGS. 5A and 5B illustrate pressure gradient curves provided by the FIG. 4 embodiment of the present invention.
Figure 5A:
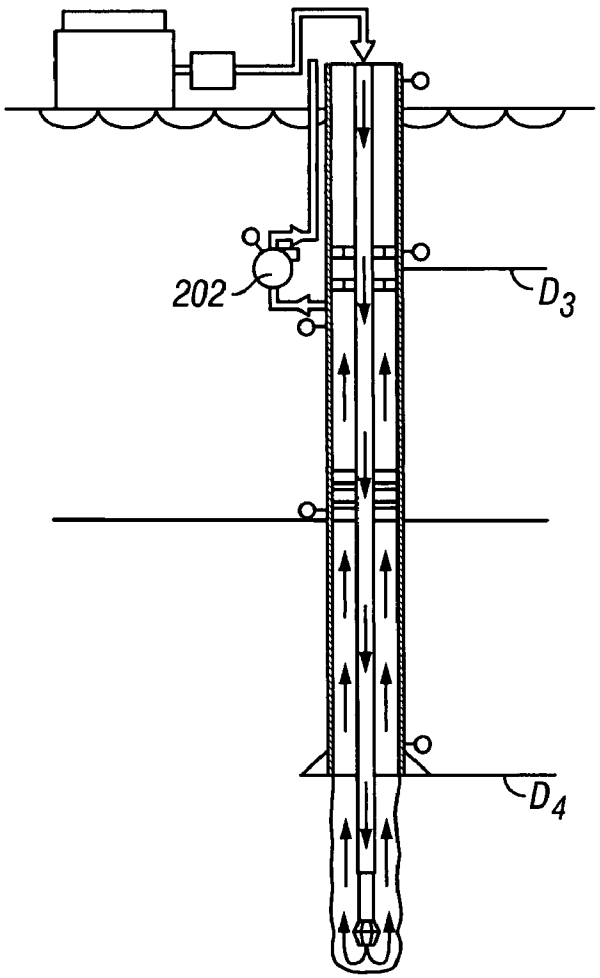

Referring now to FIGS. 5A and 5B, there is graphically illustrated the ECD control provided by the above-described embodiment of the present invention. For convenience, FIG. 5A shows the fluid lifting device 202 at a depth D3 and a representative location in the wellbore such as the casing shoe 151 at a lower depth D4. FIG. 5B provides a depth versus pressure chart having a first curve C4 representative of a pressure gradient before operation of the system 100 and a second curve C5 representative of a pressure gradients during operation of the system 100. Curve C6 represents a theoretical curve wherein the ECD condition is not present; i.e., when the well is static and not circulating and is free of drill cuttings. The pressure gradient of the non-drilling fluid material 208 (e.g., seawater) (FIG. 3) in riser is shown as curve C7 and the pressure gradient of the drilling fluid in the separate line 206 (FIG. 3) is shown as curve C8. It will be seen that a target or selected pressure at depth D3 under curve C6 cannot be met with curve C4. Advantageously, the system 200 reduces the hydrostatic pressure at depth D3 and thus shifts the pressure gradient curve as shown by curve C5, which can provide the desired predetermined pressure at depth D4. This shift is roughly the pressure drop provided by the fluid lifting device 202.

Like the wellbore system 100 of FIG. 1, the system 200 includes a controller 180 that is adapted to receive input or signals from a variety of sensors including those in the BHA 135. For brevity, the details of the several associated components will not be repeated. Further, also like system 100, the controller 180 of system 200 receives the pressure information from one or more of the sensors ($P_1$-$P_n$) and/or information from other sensors S1-S7 in the system 100. The controller 180 determines the bottomhole pressure and adjusts the energy input to the pressure differential device 202 to maintain the bottomhole pressure at a desired or predetermined value or within a desired or predetermined range. The wellbore system 200 thus provides a closed loop system for controlling the ECD by controllably diverting the returning fluid about a flow restriction device in the returning fluid path in response to one or more parameters of interest during drilling of a wellbore. This system is relatively simple and efficient and can be incorporated into new or existing drilling systems.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A system for subsea wellbore operations, comprising:

(a) a supply conduit for providing drilling fluid into a wellbore;

(b) a return conduit including a riser conveying the drilling fluid from the wellbore to a predetermined location, the supply conduit and return conduit forming a fluid circuit; and (c) an active pressure differential device ("APD device") controlling pressure in the drilling fluid in the return conduit, the APD device adapted to selectively receive the drilling fluid from a first selected location on the riser and convey the drilling fluid to a second selected location, wherein the APD device is located at one of (i) in the riser, and (ii) in an annulus of the wellbore.

2. The system according to claim 1 further comprising a flow restriction device positioned in the return conduit selectively diverting the drilling fluid from the riser to the APD device.

3. The system according to claim 1 wherein the second selected location is one of (i) a section of the riser uphole of the first selected location; and (ii) a separate line to a surface location.

4. The system according to claim 1 wherein the second selected location is a separate line to a surface location; and a section of the riser uphole of the first selected location is at least partially filled with a fluid having a density different from that of the drilling fluid and being separated from the drilling fluid by a fluid restriction device.

5. The system of claim 1, wherein the APD device is between 1000 ft. below the sea level and the sea bottom.

6. The system of claim 1, wherein the APD device is one of: (i) at least one centrifugal pump; (ii) a turbine; (iii) jet pump; and (iv) a positive displacement pump.

7. The system according to claim 1 wherein the APD device is configured to control equivalent circulating density of the drilling fluid in at least a portion of the fluid circuit.

8. The system of claim 1 further comprising a controller that controls the APD device to control the equivalent circulating density in at least a portion of the fluid circuit.

9. The system of claim 8, wherein the controller controls the APD device in response to a pressure measurement in the return line.

10. The system of claim 9, wherein the pressure is one of: (i) bottomhole pressure; (ii) measured at a location in the supply conduit; (iii) measured at well control equipment associated with the wellbore; (iv) measured in the return conduit; (v) measured in a bottomhole assembly; (vi) measured at the surface; (vii) stored in a memory associated with the controller; and (viii) measured near an inlet to the APD device.

11. The system of claim 8, wherein the controller controls the differential pressure to one of: (i) maintain the bottomhole pressure at a predetermined value; (ii) maintain the bottomhole pressure within a range; (iii) maintain the pressure in the wellbore at at-balance condition; (iv) maintain the pressure in the wellbore at under-balance condition; and (v) reduce the bottomhole pressure by a selected amount.

12. The system of claim 8, wherein the controller controls the APD device to maintain the equivalent circulating density at one of (i) a predetermined value, and (ii) within a predetermined range.

13. The system of claim 8 further comprising at least one sensor providing pressure measurements of the drilling fluid in the fluid circuit.

14. The system of claim 13, wherein the controller controls the APD device in response to the pressure measurement and according to programmed instructions provided thereto.

15. The system of claim 1 further comprising drill string disposed in the wellbore; and a drilling assembly connected to the drill string for forming the wellbore.

16. The system of claim 1 wherein a controller operably coupled to the APD device controls the APD device in response to a parameter of interest.

17. The system of claim 16, wherein the parameter of interest is one of: (i) pressure; (ii) flow rate; (iii) characteristic of fluid in the wellbore; and (iv) a formation characteristic.

18. A wellbore system for performing subsea downhole wellbore operations comprising:

(a) a tubing receiving fluid from a source adjacent an upper end of the tubing;

(b) a subsea wellhead assembly above a wellbore receiving the tubing, said wellhead assembly adapted to receive said fluid after it has passed down through said tubing and back up through an annulus between the tubing and the wellbore;

(c) a riser extending up from the wellhead assembly to the sea level for conveying returning fluid from the wellhead to the sea level, with the tubing, annulus, wellhead and the riser forming a subsea fluid circulation system;

(d) a flow restriction device adapted to restrict flow of the fluid returning to the sea level; and (e) a an active fluid flow device for diverting returning fluid around the flow restriction device to control equivalent circulating density of fluid circulating in the fluid circulation system, wherein the active fluid flow device returns the returning fluid to the surface via the riser.

19. The wellbore system of claim 18, wherein the active fluid flow device is located at one of (i) in the riser, (ii) outside the riser, and (iii) in the annulus.

20. The wellbore system of claim 18, wherein the active fluid flow device is one of: (i) at least one centrifugal pump; (ii) a turbine; (iii) and (iv) a positive displacement pump.

21. The wellbore system of claim 18, further comprising a controller that controls the fluid flow device to control the equivalent circulating density.

22. The wellbore system of claim 21, wherein the controller controls the active flow fluid device in response to pressure, the pressure being one of: (i) bottomhole pressure; (ii) measured at a location in the drill string; (iii) measured at the well control equipment; (iv) measured in the riser; (v) measured in a bottomhole assembly carrying the drill bit; (vi) measured at the surface; (vii) stored in a memory; and (viii) measured near the inlet to the active fluid flow device.

23. The wellbore system of claim 21, wherein the controller controls the differential pressure to control the bottomhole pressure to one of: (i) maintain the bottomhole pressure at a predetermined value; (ii) maintain the bottomhole pressure within a range; (iii) maintain the pressure in the wellbore at at-balance condition; (iv) maintain the pressure in the wellbore at under-balance condition; and (v) reduce the bottomhole pressure by a selected amount.

24. The wellbore system of claim 21, wherein the controller controls the fluid flow device to maintain the equivalent circulating density at one of (i) a predetermined value, and (ii) within a predetermined range.

25. The wellbore system of claim 21, wherein the controller controls the fluid flow device in response to pressure measurement provided by a sensor positioned in the drilling fluid and according to programmed instructions provided thereto.

26. The wellbore system of claim 18 further comprising a drilling assembly connected to the tubing for forming a wellbore.

* * * * *